US009767744B2

(12) United States Patent
Deng et al.

(10) Patent No.: US 9,767,744 B2
(45) Date of Patent: Sep. 19, 2017

(54) POLARITY INVERSION DRIVING METHOD AND DEVICE FOR LIQUID CRYSTAL DISPLAY PANEL

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Liguang Deng, Beijing (CN); Hyungkyu Kim, Beijing (CN); Hao Zhang, Beijing (CN); Rui Liu, Beijing (CN); Yingming Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 14/500,099

(22) Filed: Sep. 29, 2014

(65) Prior Publication Data

US 2015/0310815 A1 Oct. 29, 2015

(30) Foreign Application Priority Data

Apr. 24, 2014 (CN) ..... 2014 1 0168631

(51) Int. Cl.
*G09G 3/36* (2006.01)
*G09G 5/18* (2006.01)

(52) U.S. Cl.
CPC ..... *G09G 3/3614* (2013.01); *G09G 5/18* (2013.01)

(58) Field of Classification Search
CPC ..... G09G 3/36
See application file for complete search history.

(56) References Cited

U.S. PATENT DOCUMENTS

2004/0150600 A1* 8/2004 Kojima ..... G09G 3/3648 345/96
2006/0022929 A1* 2/2006 Hashimoto ..... G09G 3/2011 345/96

(Continued)

FOREIGN PATENT DOCUMENTS

CN 1434432 A 8/2003
CN 1920932 A 2/2007

(Continued)

OTHER PUBLICATIONS

Chinese Office Action dated Sep. 2, 2015 issued in corresponding Chinese Application No. 201410168631.4.

*Primary Examiner* — Jennifer Mehmood
*Assistant Examiner* — Carl Adams
(74) *Attorney, Agent, or Firm* — Nath, Goldberg & Meyer; Joshua B. Goldberg; Christopher Thomas

(57) ABSTRACT

The present invention provides a polarity inversion driving method for a liquid crystal display panel. The polarity inversion driving method comprises a step of performing polarity inversion on groups of pixel units according to a preset period, wherein each group of pixel units comprises rows of pixel units sequentially arranged in a same column, and a gate on-state duration of the first row of pixel unit in each group of pixel units is longer than the gate on-state duration of the remaining rows of pixel units in the group of pixel units. Correspondingly, the present invention further provides a polarity inversion driving device for a liquid crystal display panel. According to the present invention, when N-dot inversion driving is performed on the liquid crystal panel, charging times of respective rows of pixel units in each group of pixel units are closer.

10 Claims, 2 Drawing Sheets

(56) References Cited

U.S. PATENT DOCUMENTS

| | | | | |
|---|---|---|---|---|
| 2006/0033696 | A1 | 2/2006 | Nakamura et al. | |
| 2006/0284815 | A1* | 12/2006 | Kwon ..... | G09G 3/3614 345/98 |

FOREIGN PATENT DOCUMENTS

| | | | |
|---|---|---|---|
| CN | 102160108 | A | 8/2011 |
| WO | 2010/079641 | A1 | 7/2010 |

* cited by examiner

POLARITY INVERSION DRIVING METHOD AND DEVICE FOR LIQUID CRYSTAL DISPLAY PANEL

FIELD OF THE INVENTION

The present invention relates to the field of display technology, and particularly relates to a polarity inversion driving method and device for a liquid crystal display panel.

BACKGROUND OF THE INVENTION

In a liquid crystal display device, in order to prevent permanent damages caused by polarization of a liquid crystal material, a polarity inversion driving process needs to be performed on pixel units on an array substrate at regular time intervals. In order to improve the display quality of images, in an existing liquid crystal display device, an N-dot inversion driving method is commonly adopted, and here N is an integer no less than 2.

However, the polarity inversion driving method in the prior art often results in horizontal stripes related to the polarity inversion driving method, which appear on the display screen. As shown in FIG. 1, in 2-dot inversion driving process, the horizontal-stripe phenomenon occurs on the screen between two adjacent rows of pixel units; and in 3-dot inversion driving process, the stripe phenomenon occurs on the screen between the first row of pixel units and the remaining two rows of pixel units in every three rows of pixel units.

SUMMARY OF THE INVENTION

Accordingly, an object of the present invention is to provide a polarity inversion driving method and device for a liquid crystal display panel, so as to avoid the horizontal-stripe phenomenon when images are displayed.

Through repeated studies, inventors of the application find that, due to an impedance characteristic of a thin film transistor, there is a rising or dropping period before a source signal transmitted by a data wire can achieve a preset value when positive-negative inversion is performed. Moreover, in an N-dot inversion driving method in the prior art, a gate on-state duration of respective rows in each group of pixel units is the same. Thus, when inversion driving process is performed, the charging time of the first row of pixel units in each group of pixel units is less than the charging time of the remaining rows of pixel units due to the rising or dropping time during the positive-negative inversion, resulting in a difference between the charging characteristic of the first row of pixel units and the charging characteristic of the remaining rows of pixel units in each group of pixel units, and thus the horizontal-stripe phenomenon occurs in a high-resolution display screen. As shown in FIG. 2, for example, in 2-dot inversion driving, the gate on-state duration G1 of the first row of pixel units is the same as the gate on-state duration G2 of the second row of pixel units, and there is a rising time before the signal S transmitted by the data wire can achieve a preset value to charge the pixel units, so the charging time T1 of the first row of pixel units is less than the charging time T2 of the second row of pixel units. As a result, the charging characteristic of the first row of pixel units is different from the charging characteristic of the second row of pixel units, and the horizontal-stripe phenomenon occurs between the first row of pixel units and the second row of pixel units on the display screen.

Thus, in order to avoid the stripe phenomenon when the images are displayed, the present invention provides a polarity inversion driving method for a liquid crystal display panel, and the polarity inversion driving method comprises a step of performing polarity inversion on groups of pixel units according to a preset period, each group of pixel units comprises rows of pixel units sequentially arranged in a same column, wherein a gate on-state duration of the first row of pixel units in each group of pixel units is a first duration, the gate on-state duration of the remaining rows of pixel units in the group of pixel units is a second duration, and the first duration is longer than the second duration.

Preferably, the second duration of the remaining rows of pixel units other than the first row of pixel units in each group of pixel units is the same, and the difference between the first duration and the second duration is a preset duration.

Preferably, in each group of pixel units, the preset duration is a duration from a time when gates of the first row of pixel units are turned on to a time when a source voltage of the first row of pixel units reaches a preset value.

Preferably, gate lines of respective rows of pixel units in each group of pixel units are respectively connected to respective shift register units, and clock signals of the respective shift register units are controlled so that the first duration is longer than the second duration.

Preferably, the clock signals of the shift register units connected with the gate lines of the remaining rows of pixel units other than the first row of pixel units in each group of pixel units are delayed to make the first duration longer than the second duration.

Correspondingly, the present invention provides a polarity inversion driving device for a liquid crystal display panel used for performing polarity inversion on groups of pixel units according to a preset period, each group of pixel units comprises rows of pixel units sequentially arranged in a same column, wherein the polarity inversion driving device comprises a gate driving unit used for sequentially driving gates of respective rows of pixel units in each group of pixel units, a gate on-state duration of the first row of pixel units in each group of pixel units is a first duration, the gate on-state duration of the remaining rows of pixel units in the group of pixel units is a second duration, and the first duration is longer than the second duration.

Preferably, the second duration of the remaining rows of pixel units other than the first row of pixel units in each group of pixel units is the same, and the difference between the first duration and the second duration is a preset duration.

Preferably, in each group of pixel units, the preset duration is a duration from a time when gates of the first row of pixel units are turned on to a time when a source voltage of the first row of pixel units reaches a preset value.

Preferably, the gate driving unit comprises a timing control sub-unit, wherein gate lines of respective rows of pixel units in each group of pixel units are respectively connected to respective shift register units, and the timing control sub-unit is used to control clock signals of the respective shift register units so that the first duration is longer than the second duration.

Preferably, the timing control sub-unit is used for delaying the clock signals of the shift register units connected with the gate lines of the remaining rows of pixel units other than the first row of pixel units in each group of pixel units so as to make the first duration longer than the second duration.

It can be seen that, according to the present invention, in the N-dot inversion driving method for the liquid crystal panel, the gate on-state duration of the first row of pixel units in each group of pixel units is increased to enable the charging time of the first row of pixel units to be closer to the charging time of the remaining rows of pixel units, thereby avoiding the horizontal-stripe phenomenon caused by the situation that the charging time of the first row of pixel units is less than the charging time of the remaining rows of pixel units.

BRIEF DESCRIPTION OF THE DRAWINGS

The drawings are used to provide a further understanding of the present invention and constitute a part of the description. The drawings together with the following specific embodiments are used for explaining the present invention rather than limiting the present invention. In the drawings.

DETAILED DESCRIPTION OF THE EMBODIMENTS

Specific embodiments of the present invention are described in detail in combination with the accompanying drawings. It should be understood that the specific embodiments described herein are merely used for describing and explaining the present invention rather than limiting the present invention.

As an aspect of the present invention, a polarity inversion driving method for a liquid crystal display panel is provided. The polarity inversion driving method comprises a step of performing polarity inversion on groups of pixel units according to a preset period, wherein each group of pixel units comprises rows of pixel units sequentially arranged in a same column, and a gate on-state duration (namely, a first duration) of the first row of pixel units in each group of pixel units is longer than the gate on-state duration (namely, a second duration) of the remaining rows of pixel units in the group of pixel units.

Figure 1:
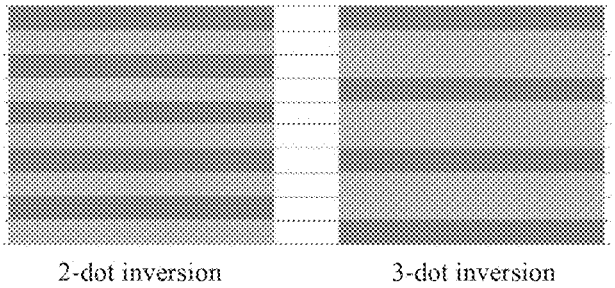
FIG. 1 is a schematic diagram of a horizontal-stripe phenomenon in the prior art.
Figure 2:
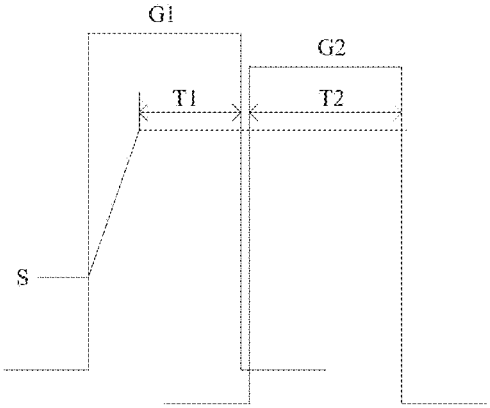
FIG. 2 is a schematic diagram of gate driving signals in the prior art.

In general, an N-dot inversion driving method is adopted for a polarity inversion driving process of the liquid crystal display panel, in which the polarity inversion driving process is performed on a group of pixel units composed of N (N is an integer no less than 2) adjacent rows of pixel units arranged in a same column, the polarities of the respective pixel units in the same group of pixel units are the same, and the polarities of the pixel units in a group of pixel units are opposite to those in a group of pixel units adjacent thereto. The inventors of the application find that in the polarity inversion driving method in the prior art, the gate on-state duration of respective rows of pixel units in each group of pixel units is the same. However, in the first row of pixel units in each group, there is a rising or dropping time for the voltage of a source signal before the voltage of the source signal reaches a preset value, the charging time of the first row of pixel units in each group is less than that of the remaining rows of pixel units in the group of pixel units, thus the charging characteristics of the respective rows of pixel units in each group of pixel units become different (the capacitances of capacitors are different), resulting in horizontal stripes appearing on the display screen, just as the case with the 2-dot and 3-dot stripe phenomena shown in FIG. 2.

According to the method provided by the present invention, the gate on-state duration (namely, the first duration) of the first row of pixel units in each group of pixel units is made longer than the gate on-state duration (namely, the second duration) of the remaining rows of pixels, so that after gates of the first row of pixel units are turned on, certain buffer time can be allowed for the voltage of the source signal to achieve a preset value, and the charging time of the first row of pixel units is increased to a certain extent.

Figure 3:
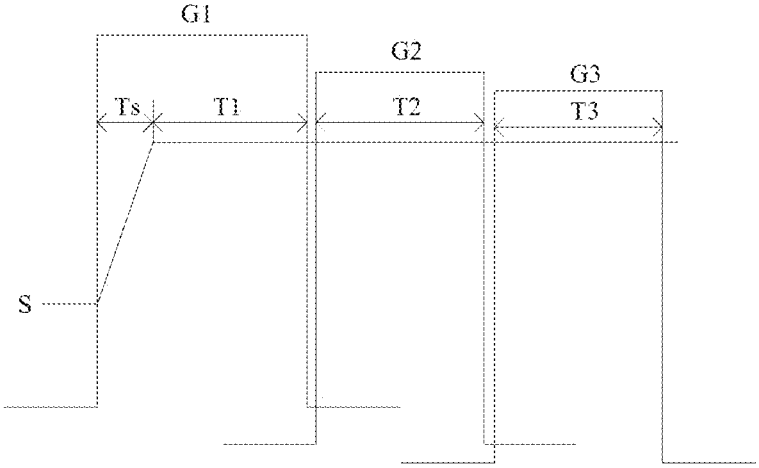
FIG. 3 is a schematic diagram of gate driving signals used in a method provided by the present invention.

FIG. 3 illustrates an example of 3-dot polarity inversion driving process according to the method provided by the present invention. As shown in FIG. 3, the gate on-state duration (namely, the first duration) G1 of the first row of pixel units can be increased to be longer than the gate on-state duration (namely, the second duration) G2 and G3 of the second row and the third row of pixel units, thereby appropriately increasing the charging time T1 of the first row of pixel units. After a source voltage achieves a preset value, the effective charging time T1 of the first row of pixel units becomes closer to the charging time T2 of the second row of pixel units and the charging time T3 of the third row of pixel units, and the charging characteristics of the respective rows of pixel units in each group of pixel units are made closer. Therefore, the horizontal-stripe phenomenon in the prior art can be effectively overcome through the method provided by the present invention.

Further, the gate on-state duration (G2 and G3 as shown in FIG. 3), namely the second duration, of the remaining rows of pixel units other than the first row of pixel units in each group of pixel units is the same, and the difference between the first duration and the second duration (namely, G1–G2) is a preset duration.

In order to avoid horizontal-stripe phenomenon, the charging characteristics of the respective rows of pixel units in each group of pixel units should be made closer. Specifically, the gate on-state duration (namely, the second duration) of the remaining rows of pixel units other than the first row of pixel units in each group of pixel units may be made the same, and the difference between the gate on-state duration (namely, the first duration) of the first row of pixel units and the second duration may be set to be the preset duration.

The preset duration can be set according to different needs. Specifically, the preset duration may be properly set so that the charging time of the first row of pixel units (T1 as shown in FIG. 3) is the same as the charging time of the remaining rows of pixel units (T2 and T3 as shown in FIG. 3) in each group of pixel units. For example, the preset duration can be set to be a duration from a time when the gates of the first row of pixel units are turned on to a time when a source voltage of the first row of pixel units reaches a preset value. As shown in FIG. 3, the duration from a time when the gates of the first row of pixel units are turned on to a time when the source voltage of the first row of pixel units reaches the preset value is Ts, so the preset duration may be set to be Ts. That is, in each group of pixel units, the gate on-state duration (namely, the first duration) of the first row of pixel units is made longer than the gate on-state duration (namely, the second duration) of the remaining rows of pixel units by Ts. In this way, after the gates of the first row of pixel units are turned on, the preset duration Ts is allowed for the voltage of the source signal to achieve the preset value; and after the source signal achieves the preset value, the charging time of the first row of pixel units T1 is the same as the charging time of the second row of pixel units T2 and the charging time T3 of the third row of pixel units. Specifically, the duration Ts from a time when the gates of the first row of pixel units are turned on to a time when the source voltage reaches the preset value can be determined in advance by means of experiments. In addition, different Ts values can be set, and the optimal Ts value can be determined by observing the display quality by means of experiments.

Further, gate lines of the respective rows of pixel units in each group of pixel units are respectively connected to respective shift register units, and clock signals of the respective shift register units may be controlled so as to make the first duration G1 longer than the second duration G2. Gate drive on array (referred to as GOA) technique is mostly adopted in the liquid crystal display panel to drive the gates of the respective rows of pixel units line by line. The gate lines of the respective rows of pixel units are connected with the corresponding shift register units, and the shift register units are controlled by the clock signals of the shift register units to shift trigger signals and output resultant gate driving signals. In addition, the gate on-state duration may be regulated by adopting a GOA technique of a gate driving integrated circuit.

Figure 4:
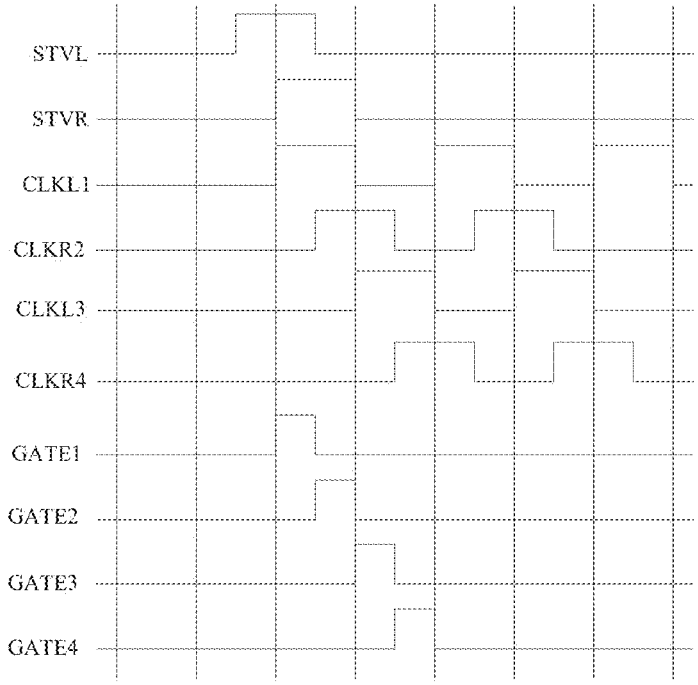
FIG. 4 is a schematic diagram of gate driving timing in the prior art.

FIG. 4 is a schematic diagram of the gate driving timing in the prior art. As shown in FIG. 4, taking 2-dot inversion driving as an example, double-sided driving technique can be adopted, wherein an STVL signal serves as the trigger signal on the left side and is used for driving the gates of the odd rows of pixel units, and an STVR signal serves as the trigger signal on the right side and is used for driving the gates of the even rows of pixel units. The STVL signal can be shifted, under the control of the clock signal CLKL1 of the shift register unit connected with the gate line of the first row of pixel units, so as to obtain a gate driving signal GATE1 of the first row of pixel units, and then the STVL signal can be shifted, under the control of the CLKL3, so as to obtain a gate driving signal GATE3 of the third row of pixel units. The STVR signal can be shifted, under the control of the clock signal CLKR2 of the shift register unit connected with the gate line of the second row of pixel units, so as to obtain a gate driving signal GATE2 of the second row of pixel units, and then the STVR signal can be shifted, under the control of the CLKR4, so as to obtain a gate driving signal GATE4 of the fourth row of pixel units. The double-sided driving technique mentioned above belongs to the prior art and is not described in detail herein.

As the gate driving signals GATE1 to GATE4 of the respective rows of pixel units are controlled by the clock signals CLKL1, CLKL2, CLKL3 and CLKL4 of the shift register units connected with the gate lines of the respective rows of pixel units, the gate driving signals GATE1 to GATE4 of the respective rows of pixel units can be regulated by controlling the clock signals of the corresponding shift register units respectively.

Figure 5:
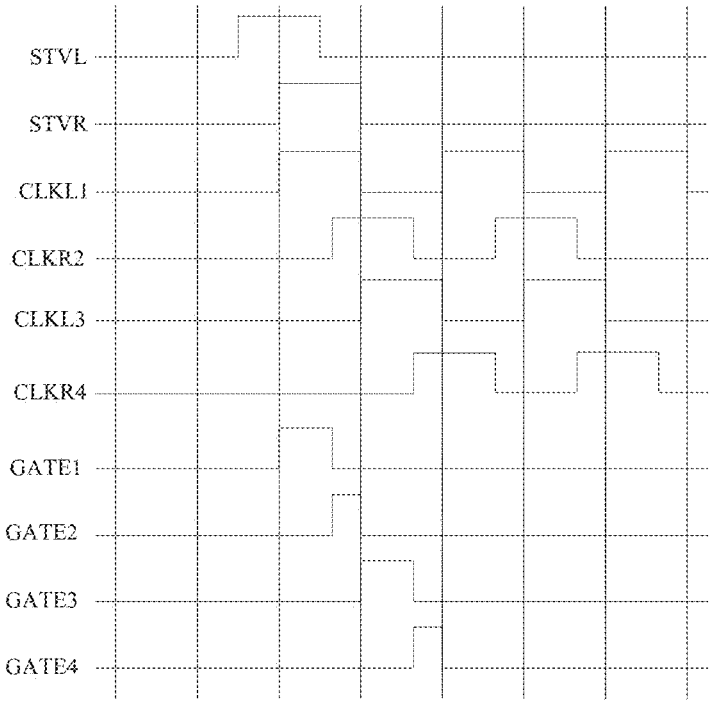
FIG. 5 is a schematic diagram of gate driving timing in a method provided by the present invention.

FIG. 5 is a schematic diagram of the gate driving timing provided by the present invention. As shown in FIG. 5, on the basis of the existing driving method, the gate on-state duration (namely, the first duration) of the first row and the third row of pixel units can be increased by controlling the clock signals CLKL1, CLKL2, CLKL3 and CLKL4, so that the first duration G1 of the gate driving signal GATE1 of the first row of pixel units is longer than the second duration G2 of the gate driving signal GATE2 of the second row of pixel units, and the first duration G1 of the gate driving signal GATE3 of the third row of pixel units is longer than the second duration G2 of the gate driving signal GATE4 of the fourth row of pixel units. Through the above method, the charging time of the respective rows of pixel units in each group of pixel units can be made closer only by controlling the clock signals for gate driving without changing the structure of an existing array substrate or driving unit, and the horizontal-stripe phenomenon can be further avoided.

Specifically, the clock signals of the shift register units connected with the gate lines of the remaining rows of pixel units other than the first row of pixel units in each group of pixel units are delayed so that the first duration G1 can be longer than the second duration G2. For example, as shown in FIG. 5, compared with the method in the prior art as shown in FIG. 4, the clock signals CLKR2 and CLKR4 are delayed to increase the on-state duration (namely, the first duration) of the gate driving signal GATE1 of the first row of pixel units and the gate driving signal GATE3 of the third row of pixel units respectively, so that the charging characteristic of the first row of pixel units is closer to that of the second row of pixel units, and the charging characteristic of the third row of pixel units is closer to that of the fourth row of pixel units.

It can be seen from the above description of the method provided by the present invention that, according to the present invention, in the N-dot inversion driving method for the liquid crystal panel, the gate on-state duration of the first row of pixel units in each group of pixel units (namely, the first duration) is increased to enable the charging time of the first row of pixel units to be closer to the charging time of the remaining rows of pixel units, thereby avoiding the horizontal-stripe phenomenon caused by the situation that the charging time of the first row of pixel units is less than the charging time of the remaining rows of pixel units.

As another aspect of the present invention, a polarity inversion driving device for a liquid crystal display panel is provided for implementing the method provided by the present invention. The polarity inversion driving device can perform polarity inversion on groups of pixel units according to a preset period, and each group of pixel units comprises rows of pixel units sequentially arranged in a same column. The polarity inversion driving device comprises a gate driving unit which is used for sequentially driving gates of respective rows of pixel units in each group of pixel units, and a gate on-state duration (namely, a first duration) of the first row of pixel units in each group of pixel units is longer than the gate on-state duration (namely, a second duration) of the remaining rows of pixel units in the group of pixel units.

Further, in the process of sequentially driving the gates of the respective rows of pixel units in each group of pixel units by the gate driving unit, the gate on-state duration (namely, the second duration) of the remaining rows of pixel units other than the first row of pixel units in each group of pixel units is the same, and the difference between the first duration and the second duration is preset duration.

Further, in each group of pixel units, the preset duration is a duration from a time when gates of the first row of pixel units are turned on to a time when a source voltage of the first row of pixel units reaches a preset value.

Further, the gate driving unit can further comprise a timing control sub-unit, wherein gate lines of respective rows of pixel units in each group of pixel units are respectively connected to respective shift register units, and the timing control sub-unit is used to control clock signals of the respective shift register units to make the first duration longer than the second duration.

More further, the timing control sub-unit can be used for delaying the clock signals of the shift register units connected with the gate lines of the remaining rows of pixel units other than the first row of pixel units in each group of pixel units so as to make the first duration longer than the second duration.

It can be understood that the above embodiments are merely exemplary embodiments used for describing the principle of the present invention, but the present invention is not limited thereto. Various variations and improvements can be made by the person skill in the art without departing from the spirit and essence of the present invention, and these variations and improvements are also considered to be within the protection range of the present invention.

The invention claimed is:

1. An N-dot polarity inversion driving method for a liquid crystal display panel, comprising a step of performing N-dot polarity inversion on groups of pixel units according to a preset period, each group of pixel units comprising rows of pixel units sequentially arranged in a same column, wherein the N-dot polarity inversion is performed once in each preset period, wherein a gate of each of the pixel units in one of the groups is turned on in one preset period, and wherein a gate on-state duration of the first row of pixel unit in each group of pixel units is a first duration, the gate on-state duration of each of the remaining rows of pixel units in the group of pixel units is a second duration, the first duration and the second duration are all durations in one preset period, and the first duration is longer than the second duration.

2. The N-dot polarity inversion driving method for a liquid crystal display panel according to claim 1, wherein the second duration of each of the remaining rows of pixel units other than the first row of pixel units in each group of pixel units is the same, and the difference between the first duration and the second duration is a preset duration.

3. The N-dot polarity inversion driving method for a liquid crystal display panel according to claim 2, wherein in each group of pixel units, the preset duration is a duration from a time when gates of the first row of pixel units are turned on to a time when a source voltage of the first row of pixel units reaches a preset value.

4. The N-dot polarity inversion driving method for a liquid crystal display panel according to claim 1, wherein gate lines of respective rows of pixel units in each group of pixel units are respectively connected to respective shift register units, and clock signals of the respective shift register units are controlled so that the first duration is longer than the second duration.

5. The N-dot polarity inversion driving method for a liquid crystal display panel according to claim 4, wherein the clock signals of the shift register units connected with the gate lines of each of the remaining rows of pixel units other than the first row of pixel units in each group of pixel units are delayed to make the first duration longer than the second duration.

6. An N-dot polarity inversion driving device for a liquid crystal display panel used for performing N-dot polarity inversion on groups of pixel units according to a preset period, each group of pixel units comprising rows of pixel units sequentially arranged in a same column, wherein the N-dot polarity inversion is performed once in each preset period, wherein a gate of each of the pixel units in one of the groups is turned on in one preset period, and the N-dot polarity inversion driving device comprising a gate driving unit used for sequentially driving gates of respective rows of pixel units in each group of pixel units, wherein a gate on-state duration of the first row of pixel unit in each group of pixel units is a first duration, the gate on-state duration of each of the remaining rows of pixel units in the group of pixel units is a second duration, the first duration and the second duration are all durations in one preset period, and the first duration is longer than the second duration.

7. The N-dot polarity inversion driving device according to claim 6, wherein the second duration of each of the remaining rows of pixel units other than the first row of pixel units in each group of pixel units is the same, and the difference between the first duration and the second duration is a preset duration.

8. The N-dot polarity inversion driving device according to claim 7, wherein in each group of pixel units, the preset duration is a duration from a time when gates of the first row of pixel units are turned on to a time when a source voltage of the first row of pixel units reaches a preset value.

9. The N-dot polarity inversion driving device according to claim 6, wherein the gate driving unit comprises a timing control sub-unit, gate lines of respective rows of pixel units in each group of pixel units are respectively connected to respective shift register units, and the timing control sub-unit is used to control clock signals of the respective shift register units so that the first duration is longer than the second duration.

10. The N-dot polarity inversion driving device according to claim 9, wherein the timing control sub-unit is used for delaying the clock signals of the shift register units connected with the gate lines of each of the remaining rows of pixel units other than the first row of pixel units in each group of pixel units so as to make the first duration longer than the second duration.

* * * * *